US005677118A

United States Patent [19]

Spara et al.

[11] Patent Number: 5,677,118

[45] Date of Patent: Oct. 14, 1997

[54] PHOTOGRAPHIC ELEMENT CONTAINING A RECRYSTALLIZABLE 5-PYRAZOLONE PHOTOGRAPHIC COUPLER

[75] Inventors: Paul Patrick Spara, Fairport; Sundaram Krishnamurthy, Penfield; Stanley Wray Cowan, Rochester; Ruthann M. McGarry, Fairport, all of N.Y.

[73] Assignee: Eastman Kodak Company, Rochester, N.Y.

[21] Appl. No.: 693,938

[22] Filed: May 10, 1996

Related U.S. Application Data

[60] Provisional application No. 60/004,838, Oct. 5, 1995.

[51] Int. Cl. [6] ..... G03C 7/384

[52] U.S. Cl. ..... 430/555

[58] Field of Search ..... 430/555

[56] References Cited

U.S. PATENT DOCUMENTS

| | | | |
|---|---|---|---|
| 5,256,528 | 10/1993 | Merkel et al. | 430/555 |
| 5,262,292 | 11/1993 | Krishnamurthy et al. | 430/555 |
| 5,389,504 | 2/1995 | Ling et al. | 430/555 |
| 5,447,830 | 9/1995 | Pawlak et al. | 430/555 |
| 5,462,848 | 10/1995 | Merkel et al. | 430/555 |
| 5,576,166 | 11/1996 | Sugita et al. | 430/555 |

*Primary Examiner*—Lee C. Wright
*Attorney, Agent, or Firm*—Arthur E. Kluegel

[57] ABSTRACT

The invention provides a photographic element comprising a support bearing at least one silver halide emulsion layer having associated therewith a 5-pyrazolone photographic coupler represented by the formula (I):

wherein a) substituents $G^1$, $G^2$ and $G^3$ are individually selected from the group consisting of hydrogen, halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, and carboxy groups;

b) a and b are individually integers from 0 to 5, provided that the sum of the sigma values for $G^1$ and $G^2$ is at least 1.3; and c is an integer from 0 to 4;

c) Z is a group of the formula (II):

wherein $R^1$ is selected from the group consisting of hydrogen, alkyl, alkenyl, aryl, acyl, and heterocyclic groups; $R^2$ is hydrogen; $R^3$ is selected from the group consisting of hydrogen and alkyl groups having from 1 to 16 carbon atom; and each $R^4$ is an identically substituted methyl or silyl group.

10 Claims, No Drawings

PHOTOGRAPHIC ELEMENT CONTAINING A RECRYSTALLIZABLE 5-PYRAZOLONE PHOTOGRAPHIC COUPLER

CROSS REFERENCE TO RELATED APPLICATION

Reference is made to and priority claimed from U.S. Provisional application Ser. No. U.S. Ser. No. 60/004,838, filed 05 Oct. 1995, entitled PHOTOGRAPHIC ELEMENT CONTAINING A RECRYSTALLIZABLE 5-PYRAZOLONE PHOTOGRAPHIC COUPLER.

FIELD OF THE INVENTION

This invention relates to photographic elements containing new 5-pyrazolone couplers comprising a parent 1-phenyl-3-anilino-pyrazolo-5-one and a phenylthio coupling-off group containing substituents improving the crystallinity of the coupler and providing desirable photographic performance.

BACKGROUND OF THE INVENTION

The use of magenta couplers comprising a parent 1-phenyl-3-anilino-pyrazolo-5-one and a phenylthio coupling-off group at the 4-position are well known in the photographic field. See for example, U.S. Pat. No 4,853,319 of Krishnamurthy et al. and other patents cited herein. These magenta couplers are two-equivalent couplers which provide magenta dye images having useful photographic properties. In particular, less silver halide and coupler have to be used to obtain adequate dye yield when compared to four-equivalent couplers. This decreases the costs associated with this type of coupler.

Examples of so-called 2-equivalent 3-anilino-4-(arylthio) pyrazolones are described in, for example, U.S. Pat. No 4,413,054, Japanese published patent application 60/057839, U.S. Pat. Nos. 4,876,182, 4,900,657, and 4,351,897. An example of such a pyrazolone coupler described in, for example, U.S. Pat. No. 4,853,319, is designated herein as comparative coupler C-1 and is represented by the formula:

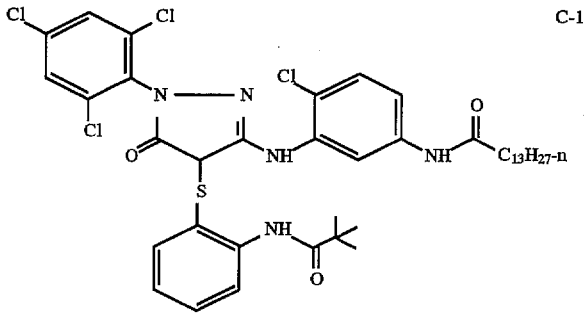

C-1

The presence of an acylamine group in the ortho position on the phenylthio coupling-off group of coupler C-1 has provided advantageous properties. This coupler does not require Lippman fine grain silver halide in order to obtain adequate dye density upon rapid machine processing. However, this type of coupler does suffer from unwanted gains in green density in unexposed areas upon standing in the dark. Another problem with couplers of this type is their sensitivity to calcium ions. Calcium ions are present in varying concentrations in the water used by different processing laboratories. In the presence of polyvalent cations such as calcium, the amount of dye formed from a given amount of exposure is reduced relative to a process with no polyvalent cations. This calcium ion sensitivity leads to variability in the dye densities produced during processing. In particular, an increased amount of calcium ion in a seasoned process leads to unacceptable loss in dye yield with this type of coupler.

Another example of a pyrazolone coupler known to the art designated as comparative coupler C-2, described in U.S. Pat. No. 4,853,319 is represented by the formula:

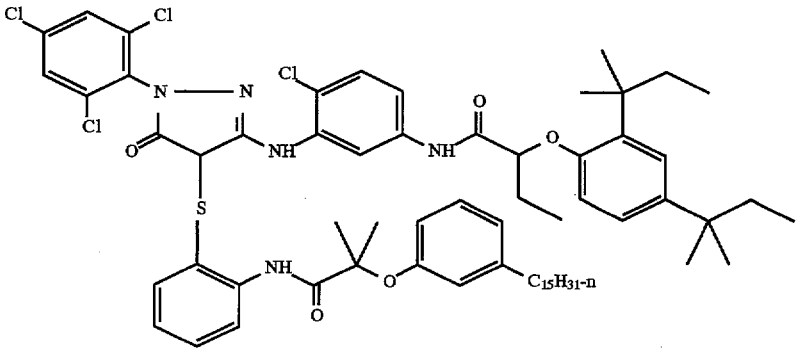

C-2

This coupler also does not require Lippman fine grain silver halide in order to obtain adequate dye density upon rapid machine processing. However, this type of coupler also gives reduced dye yields in the presence of polyvalent cations, in particular, calcium ions. Further, many of the couplers described in that patent are not easily crystallized. The ability to purify a coupler by recrystallization is essential for manufacturing on a large scale, since the alternative method of purification by liquid chromatography is laborious and time-consuming.

U.S. patent application Ser. No. 08/083,842 describes a photographic element comprising a new 3-anilinopyrazolone coupler having a phenylthio coupling-off group capable of forming a magenta dye image. An example of this coupler, designated as comparative example C-3, is represented by the following formula:

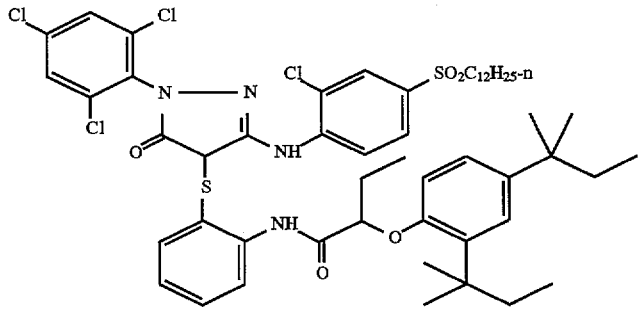

(C-3)

This coupler is capable of forming a magenta image of a good stability, with a high dye yield based on rapid machine processing, and with reduction or omission of Lippman fine grain silver halide in the element. Further, this coupler provided an excellent thermal stability in areas of no light exposure. However, the shortcoming of this coupler is that it is non crystallizable. Indeed, the above coupler is obtained in amorphous glass form. Further, the purification of this coupler is not easy and requires purification by chromatography.

Other couplers exemplified in this above application are represented by the following formula:

These couplers are crystallizable. It is believed that the nonchirality of the α carbon of the acylamino group of the coupling off group influences the crystallinity of the obtained coupler. However, coupler C-5 was obtained with a low yield (less than 50%). Further, the presence of a nonchiral carbon on the acylamino group of this coupling-off group adversely affects on the photographic results. Specifically, the nonchirality of the α carbon of the acylamino group of the coupling off group compromises the image dye stability. The photographic material including this coupler further shows a light-induced discoloration of the unexposed portion of material and a Dmin stain.

Another example of pyrazolone magenta dye-forming couplers known to the art is disclosed in U.S. Pat. No. 5,262,292 and is represented by the following formula:

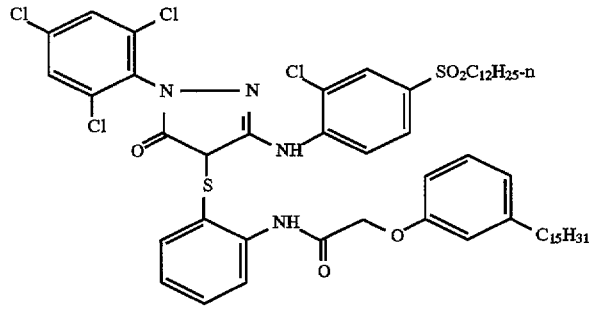

(C-4)

and

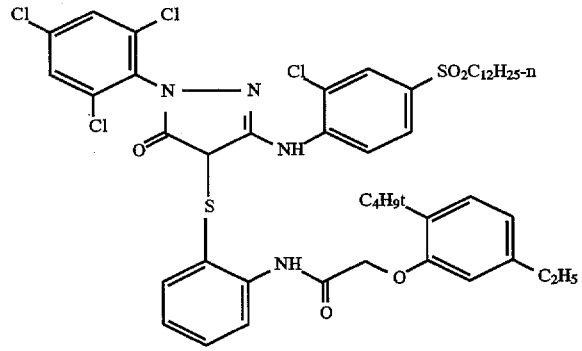

(C-5)

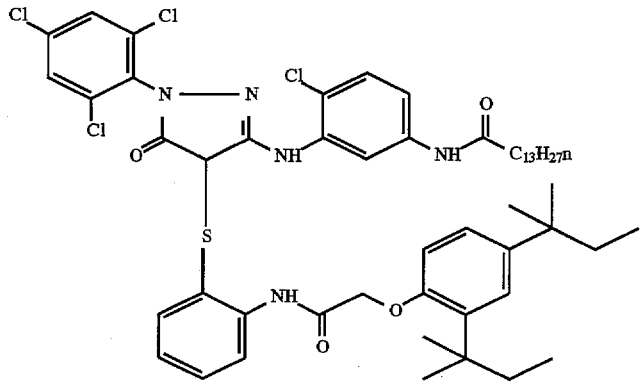

(C-6)

This coupler is crystallizable, so it improves the manufacturing and handling characteristics of the materials. However, the photographic material including this coupler shows a light-induced discoloration of the unexposed portion of material and a Dmin stain. Further, a shortcoming of this coupler is its poor image dye stability.

Another type of coupler that has been considered is one having a pentachloro-substitution on the N-phenyl ring (U.S. Pat. No. 4,876,182). While such materials provide advantageous properties they are not preferred because of the inherent toxicity of rings containing more than 3 chloro substituents and the resulting laborious and costly administrative orders relative to disposal.

An object of this invention is to provide a new 5-pyrazolone coupler having a phenylthio coupling-off group which is easily crystallizable and manufacturable on a large scale with a high yield. It is further desired to provide such a 2-equivalent coupler capable of providing a magenta dye image with good photographic performance with respect to sensitometry, dye hue, dye stability, and stability against printout discoloration in the unexposed areas of the sensitized element after processing.

SUMMARY OF THE INVENTION

It has been found that these objectives are achieved in a color photographic element comprising a support bearing at least one silver halide emulsion layer having associated therewith a 5-pyrazolone photographic coupler represented by the formula (I):

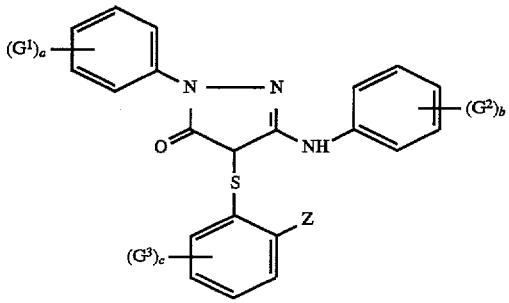

wherein a) substituents $G^1$, $G^2$ and $G^3$ are individually selected from the group consisting of hydrogen, halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, and carboxy groups;

b) a and b are individually an integer from 0 to 5, provided that the sum of the sigma values for $G^1$ and $G^2$ is at least 1.3; c is an integer from 0 to 4; and c) Z is a group of the formula (II):

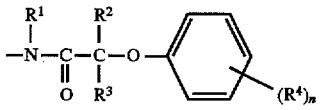

wherein $R^1$ is selected from the group consisting of hydrogen, alkyl, alkenyl, aryl, acyl, and heterocyclic groups; $R^2$ is hydrogen; $R^3$ is selected from the group consisting of hydrogen, and alkyl groups having from 1 to 16 carbon atoms; and each $R^4$ is an identically substituted methyl or silyl group.

The invention provides a new 2-equivalent pyrazolone coupler which is capable of forming a magenta dye image with a high sensitometric performance. Additionally, the element of the present invention has an improved printout, i.e., a lower light-induced discoloration of the unexposed portions of the processed sensitized photographic element. Further, the present invention provides a new coupler which can be easily manufactured on a large scale with a high yield.

DETAILED DESCRIPTION OF THE INVENTION

In preferred pyrazolone couplers represented by the above formula, Z is represented by the formula:

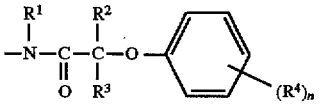

wherein $R^1$, $R^2$, $R^3$ and $R^4$ groups are as defined above.

When n is 2, $R^4$ groups are located on the 2-, 4-positions, 2-, 6-positions or 3-, 5-positions of the aryl group; and when n is 3, $R^4$ groups are located on 2-, 4-, 6-positions of the aryl group.

According to a preferred embodiment, $R^4$ is preferably represented by the following formula:

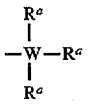

wherein W is selected from the group consisting of carbon atom and silicon atom, $R^a$ is selected from the group consisting of hydrogen, alkyl group from 1 to 3 carbon atoms, and heterocyclic or carbocyclic aromatic group from 3 to 6 carbon atoms; and n is 1, 2 or 3.

According to one embodiment, the 5-pyrazolone photographic couplers of the invention have the following formula:

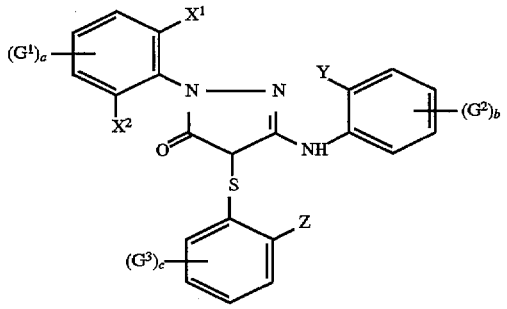

wherein a) substituents $X^1$ and $X^2$ are selected from the group consisting of $G^1$; Y is selected from the group consisting of $G^2$; $G^1$, $G^2$ and $G^3$ being as previously defined in the description;

b) a is an integer from 0 to 3; and b is an integer from 0 to 4 provided that the sum of the sigma values for $G^1$, $X^1$, $X^2$, Y and $G^2$ is at least 1.3; and c is an integer from 0 to 4; and c) Z is defined by the formula:

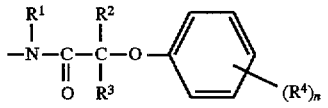

wherein $R^1$ is selected from the group consisting of hydrogen, alkyl, alkenyl, aryl, acyl, and heterocyclic groups; $R^2$ is hydrogen; $R^3$ is selected from the group consisting of hydrogen, alkyl group having from 1 to 16 carbon atoms; and $R^4$ has the following formula:

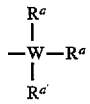

wherein W is selected from the group consisting of carbon atom and silicon atom, $R^a$ is selected from the group consisting of hydrogen, alkyl group from 1 to 3 carbon atoms, and heterocyclic or carbocyclic aryl group; and n is 1, 2 or 3.

According to one embodiment, $R^4$ group has the formula:

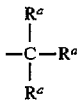

wherein $R^a$ groups are as defined above. Preferably $R^a$ is a methyl group.

It has also been found desirable under such circumstances that at least one $G^2$ is an electron-withdrawing group. According to this particular embodiment, the photographic element of the present invention comprises a 5-pyrazolone photographic coupler having the following formula:

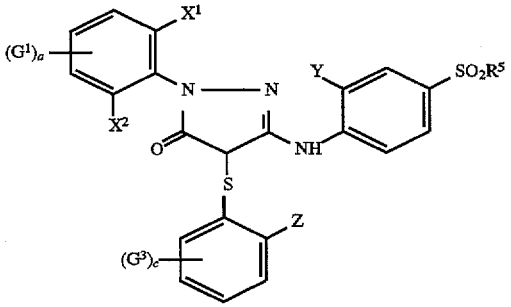

wherein a) substituents $G^1$, $G^3$, $X^1$, $X^2$ and Y are such as defined above; and $R^5$ is selected from the group consisting of alkyl group having from 1 to 20 atom carbons, —NHR' wherein R' is an alkyl group from 1 to 20 carbon atoms;

b) a is an integer from 0 to 3 provided that the sum of the sigma values for $G^1$, $X^1$, $X^2$, Y, $—SO_2R^5$ is at least 1.3; and c is an integer from 0 to 4;

c) Z is as defined above.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl or cyclic alkyl, such as methyl, trifluoromethyl, ethyl, t-butyl, 3-(2,4-di-t-pentylphenoxy)propyl, and tetradecyl; alkenyl such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The pyrazolone coupler can be a monomeric, dimeric, trimeric, oligomeric or polymeric coupler, wherein the coupler moiety can be attached to the polymeric backbone via a substituent on the pyrazolone nucleus, or a substituent of the coupling-off group.

Examples of $G^1$, $G^2$, $G^3$, $X^1$, $X^2$ and Y are hydrogen; halogen, such as chlorine, bromine or fluorine; alkyl, including straight or branched chain alkyl, such as alkyl containing 1 to 30 carbon atoms, for example methyl, trifluoromethyl, ethyl, t-butyl, and tetradecyl; alkoxy, such as alkoxy containing 1 to 30 carbon atoms, for example methoxy, ethoxy, 2-ethylhexyloxy and tetradecyloxy; aryloxy such as phenoxy, a- or b-naphthyloxy, and 4-tolyloxy; acylamino, such as acetamido, benzamido, butyramido, tetradecanamido, a-(2,4-di-t-pentylphenoxy)-acetamido, a-(2,4-di-t-pentylphenoxy)butyramido, a-(3-pentadecylphenoxy)hexanamido, a-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, and t-butylcarbonamido; sulfonamido, such as methanesulfonamido, benzenesulfonamido, p-toluenesulfonamido, p-dodecylbenzenesulfonamido, N-methyltetradecylsulfonamido, and hexadecanesulfonamido; sulfamoyl, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as N-methylsulfamido and N-octdecylsulfamido; carbamoyl, such as N-methylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkylsulfonyl, such as alkylsulfonyl containing 1 to 30 carbon atoms, for example methylsulfonyl, octylsulfonyl, 2-ethylhexylsulfonyl,and hexadecylsulfonyl; arylsulfonyl, such as benzylsulfonyl, 4-nonylbenzylsulfonyl, and p-toluenesulfonyl; alkylsulfoxyl, such as methylsulfoxyl, ethylsulfoxyl; arylsulfoxyl, such as benzylsulfoxyl, naphthylsulfoxyl; alkylthio, such as alkylthio containing 1 to 22 carbon atoms, for example ethylthio, octylthio, benzylthio, tetradecylthio, and 2-(2,4-di-t-pentylphenoxy)ethylthio; arylthio, such as phenylthio and p-tolylthio; alkoxycarbonylamino, such as ethoxycarbonylamino, benzyloxycarbonylamino, and hexadecyloxycarbonylamino; alkylureido, such as N-methylureido, N,N-dimethylureido, N-methyl-N-dodecylureido, N-hexadecylureido, N,N-dioctadecylureido, and N,N-dioctyl-N'-ethyl-ureido; acyloxy, such as acetyloxy, benzoyloxy, octadecanoyloxy, p-dodecanamidobenzoyloxy, and cyclohexanecarbonyloxy; aryloxycarbonylamino, such as benzyloxycarbonylamino; nitro; cyano and carboxy (—COOH).

The parameter sigma has well established values. The values for this constant can be easily found in the published literature (C. Hansch and A. J. Leo, in "Substituent Constants for Correlation Analysis in Chemistry and Biology", Wiley, New York, 1979; Albert J. Leo, in "Comprehensive Medicinal Chemistry", edited by C. Hansch, P. G. Sees, and J. B. Taylor, Pergamon Press, New York, Volume 4, 1990. "The Chemists' Companion", A. J. Gordon and R. A. Ford, John Wiley & Sons, New York, 1972 and "Progress in Physical Organic Chemistry", V. 13, R. W. Taft, Ed., John Wiley & Sons, New York.) Generally, sigma increases with increasing electron withdrawing power of the substituent with hydrogen=zero. In calculating the values of sigma, only the atoms close to the ring have an electron withdrawing effect and remote atoms have no effect.

The term "coupler" herein refers to the entire compound, including the coupler moiety and the coupling-off group. The terms "coupler moiety" "(COUP)", and parent refer to that portion of the compound other than the coupling-off group.

The coupler moiety (COUP) can be any 5-pyrazolone coupler moiety useful in the photographic art to form a color reaction product particularly a magenta dye, with oxidized color developing agent provided the substituents meet the requirements above described. Useful pyrazolone coupler moieties are described in, for example, U.S. Pat. Nos. 4,413,054; U.S. Pat. No. 4,853,319; U.S. Pat. No. 4,443,536; U.S. Pat. No. 4,199,361; U.S. Pat. No. 4,351,897; U.S. Pat. 4,385,111; Japanese Published Patent Application 60/170854; U.S. Pat. No. 3,419,391; U.S. Pat. No. 3,311,476; U.S. Pat. No. 3,519,429; U.S. Pat. No. 3,152,896; U.S. Pat. No. 2,311,082; and U.S. Pat. No. 2,343,703; the disclosures of which are incorporated herein by reference. The coupling-off group, if any, on the pyrazolone coupler moiety described in these patents or patent applications can be replaced by a coupling-off group according to the invention. The pyrazolone coupler according to the invention can be in a photographic element in combination with other magenta couplers known or used in the photographic art, such as in combination with at least one of the pyrazolone couplers described in these patents or published patent applications of the invention. The COUP portion of the couplers can be obtained as it is known to the art. For example, syntheses of COUP moieties are described in Item 16736 in Research Disclosure, March 1978; U.K. Patent Specification 1,530,272; U.S. Pat. No. 3,907,571; and U.S. Pat. No. 3,928,044.

Illustrative COUPs are:

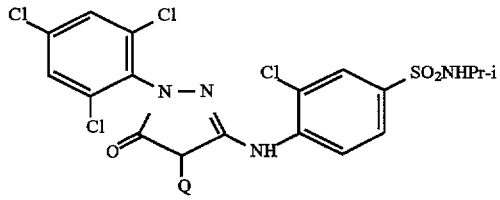

M-1

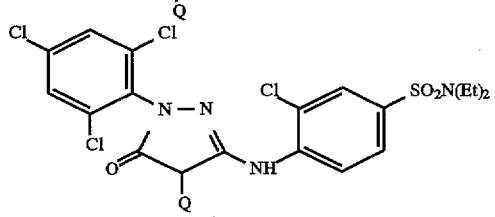

M-2

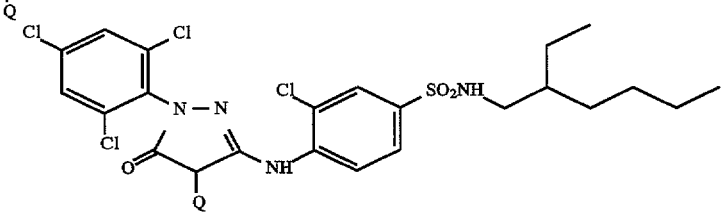

M-3

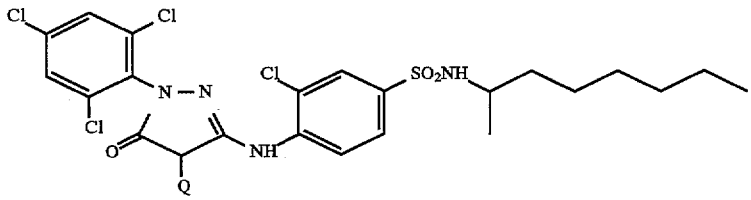

M-4

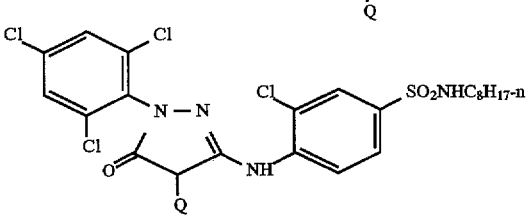

M-5

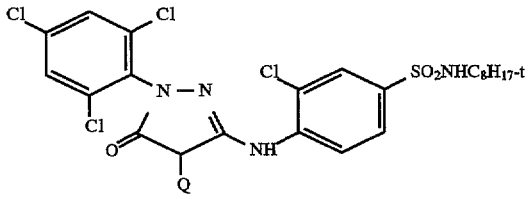

M-6

-continued
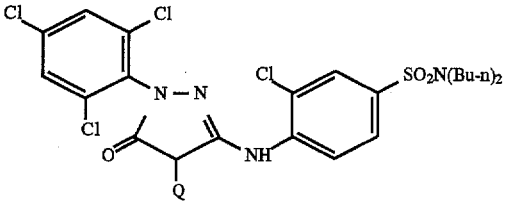
M-7
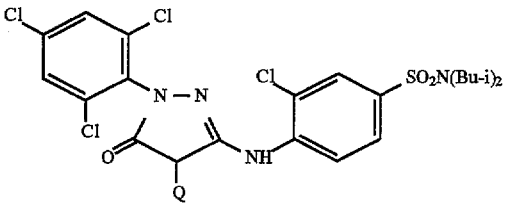
M-8
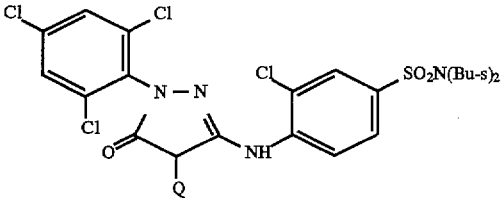
M-9
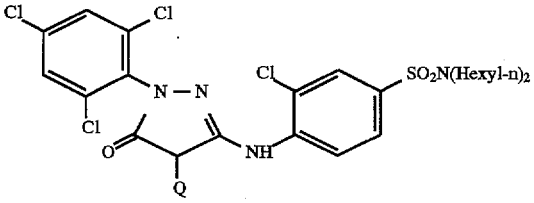
M-10
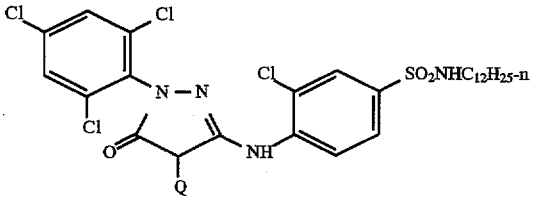
M-11
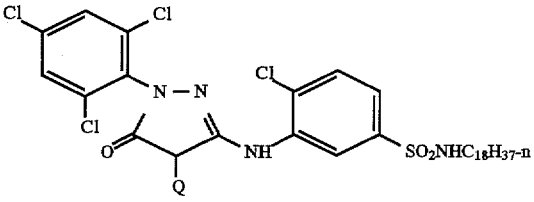
M-12
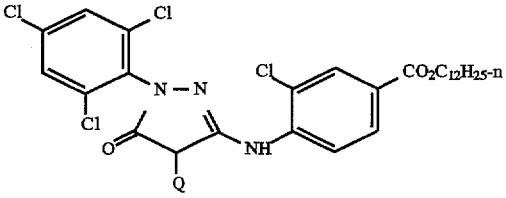
M-13
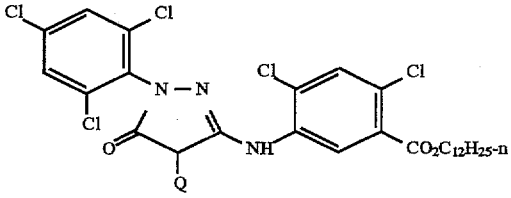
M-14
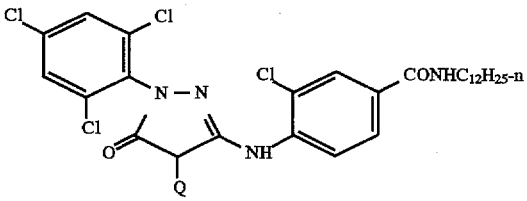
M-15
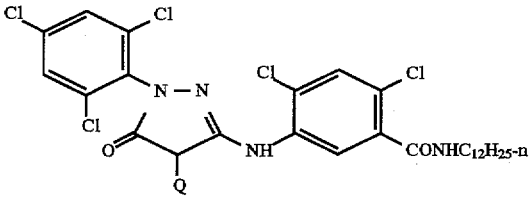
M-16
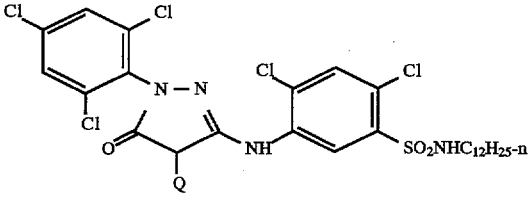
M-17
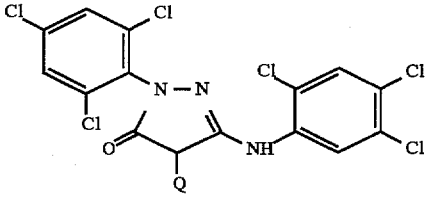
M-18
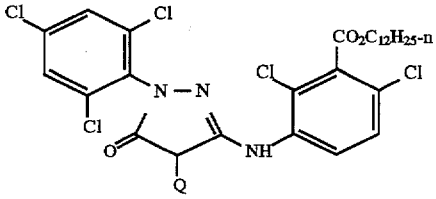
M-19
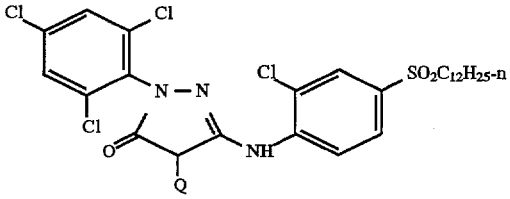
M-20
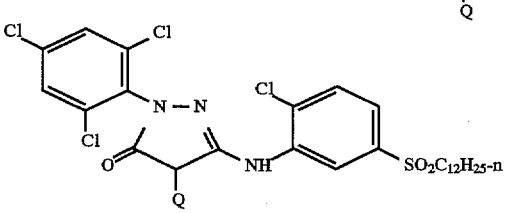
M-21

-continued
M-22
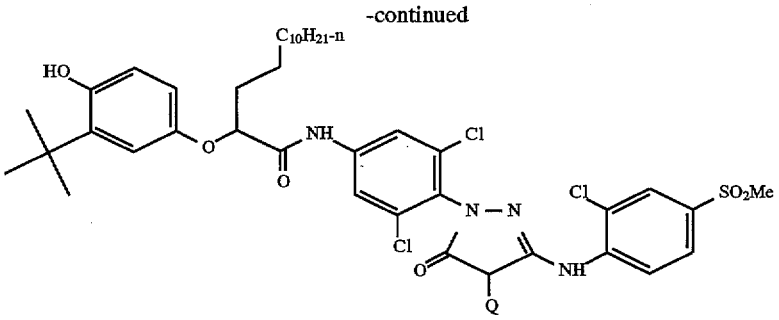
M-23
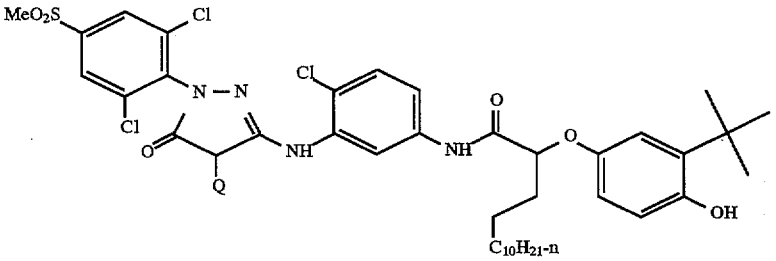
Q herein represents a coupling-off group according to the invention.
Illustrative coupling off groups (Q) are as follows:
Q-1
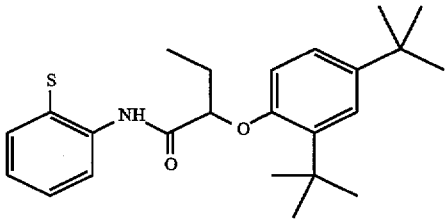
Q-2
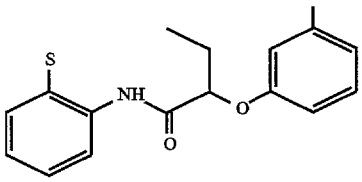
Q-3
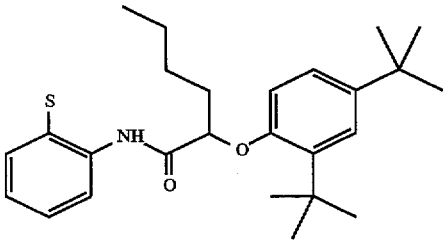
Q-4
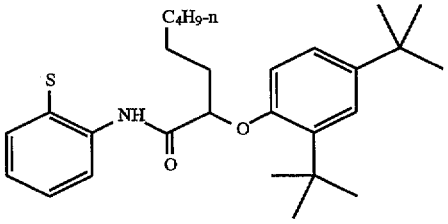
-continued
Q-5
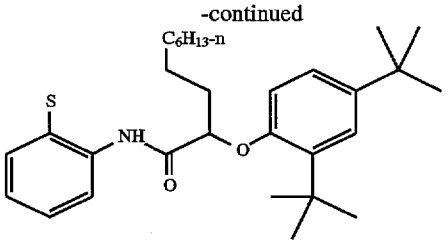
Q-6
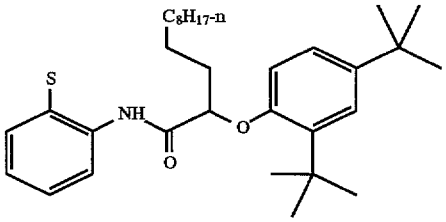
Q-7
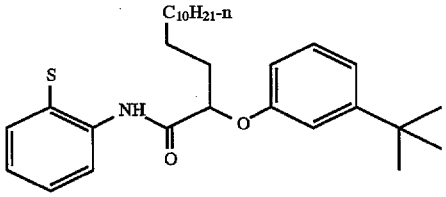
Q-8
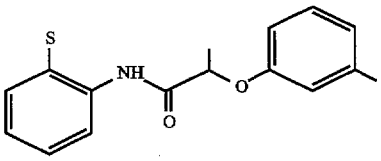
Q-9
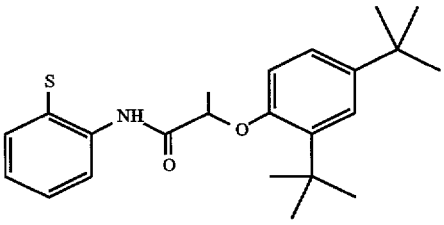

-continued

Q-10

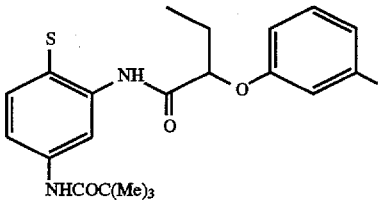

Q-11

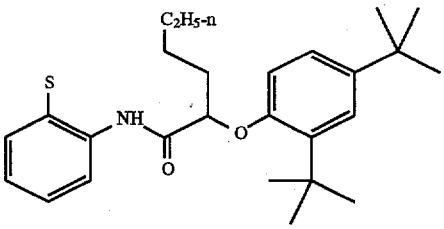

Q-12

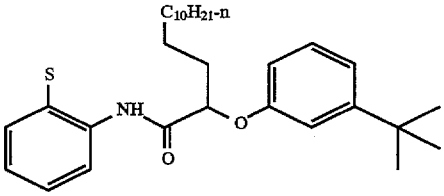

Q-13

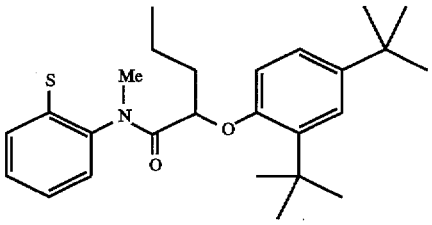

Q-14

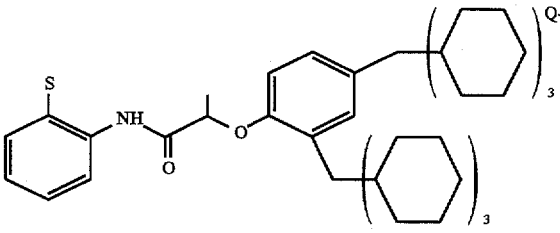

Q-15

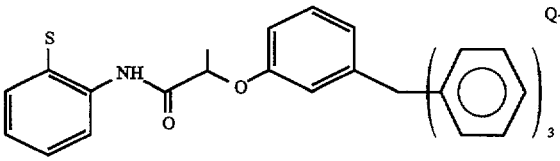

Q-16

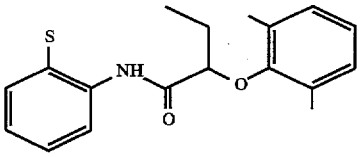

-continued

Q-17

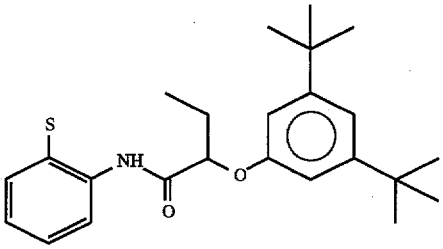

Q-18

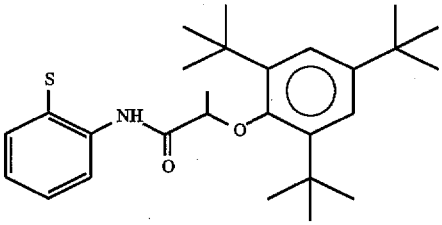

Q-19

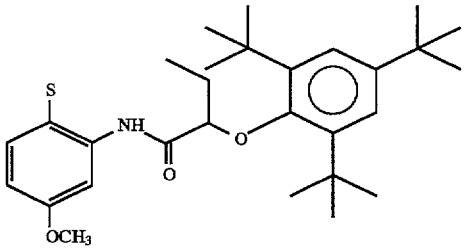

Q-20

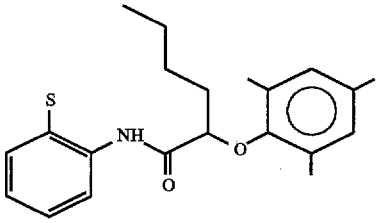

The couplers of this invention can be prepared by reacting the parent 4-equivalent coupler containing no coupling-off group with the aryl disulfide of the coupling-off group according to the invention. This is a simple method which does not involve multiple complicated synthesis steps. The reaction is typically carried out in a solvent, such as dimethylformamide, ethylacetate or pyridine.

The couplers according to the invention can be prepared from any of the known methods by the following illustrative synthetic scheme, where COUP represents the coupler moiety having the coupling-off group attached at its coupling position:

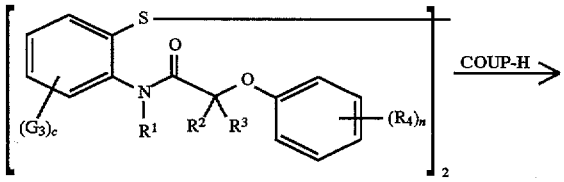

-continued

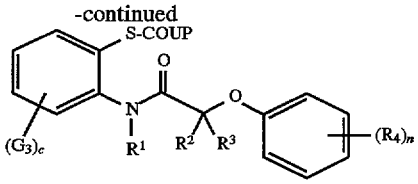

wherein COUP is the coupler moiety and $R^1$, $R^2$, $R^3$, $R^4$, $G^3$ are as previously defined. According to one embodiment, the couplers are prepared by reacting the disulfide compound with COUP in presence of ethylacetate (solvent), triethylamine, and dimethylsulfoxide. According to another embodiment, the couplers are prepared by reacting the disulfide compound with COUP in presence of dimethylformamide (solvent), potassium acetate, and dimethylsulfoxide.

The pyrazolone couplers preferably comprise a ballast group. The ballast group can be any ballast known in the photographic art. The ballast is typically one that does not adversely affect reactivity, stability and other desired properties of the coupler of the invention and does not adversely affect the stability, hue and other desired properties of the dye formed from the coupler. The ballast group is generally a high molecular weight hydrophobic group useful to control the migration of various components. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The couplers of the present invention can be used in any of the ways and in any of the combinations known in the art. Typically, the couplers are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

The photographic elements of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

For example, the coupler of the invention can be used to replace all or part of the image coupler or may be added to one or more of the other layers of the photographic element.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

With regard to the inclusion of other couplers in the element of the present invention, the presence of certain coupling-off group is well known in the art. Such groups can determine the chemical eguivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3.880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

The magenta couplers described herein may be used in combination with other classes of magenta image couplers well known in the art. Magenta couplers are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Patent Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

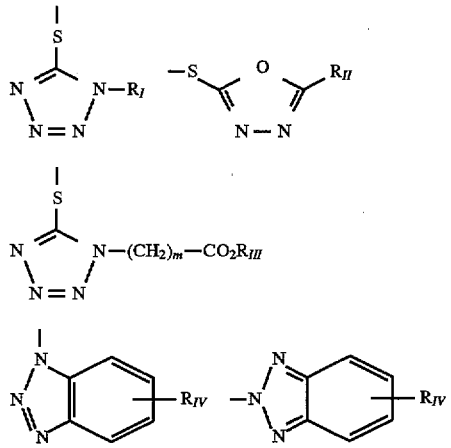

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

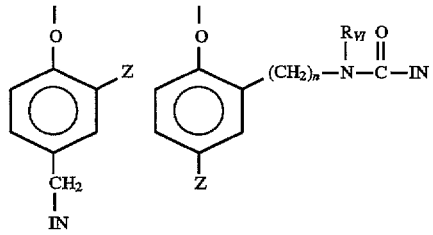

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

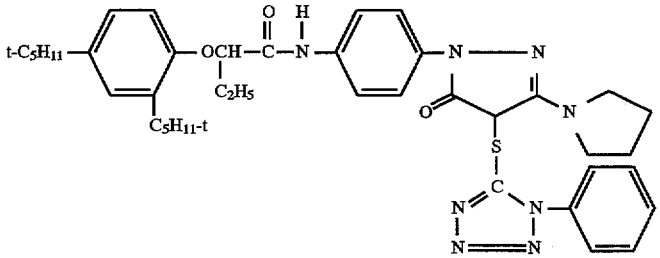

D2

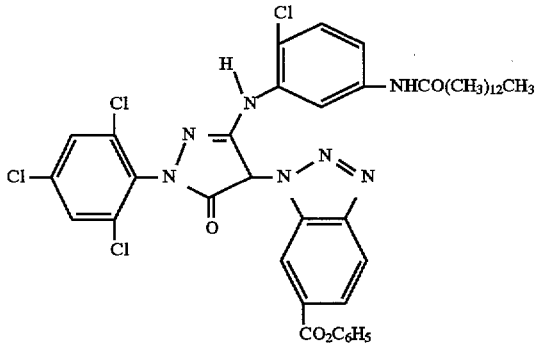

-continued
D3
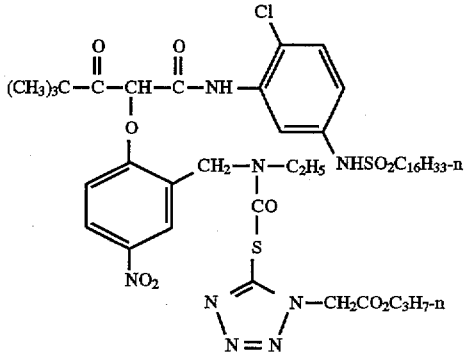
D4
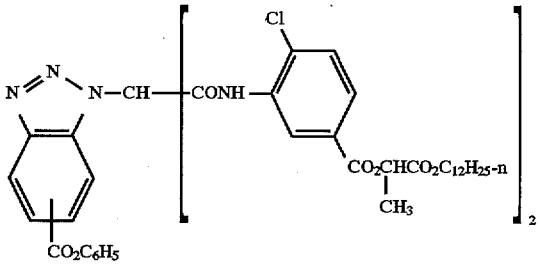
D5
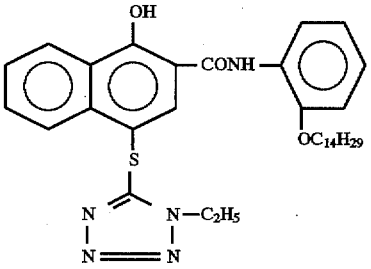
D6
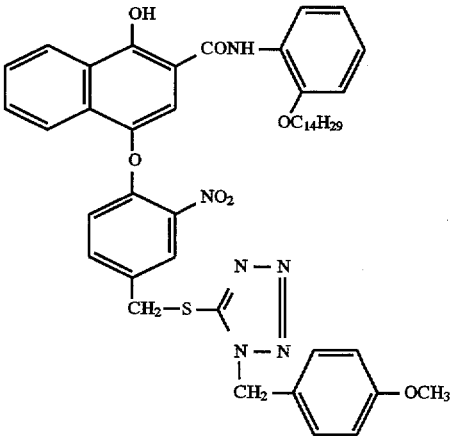

-continued
D7
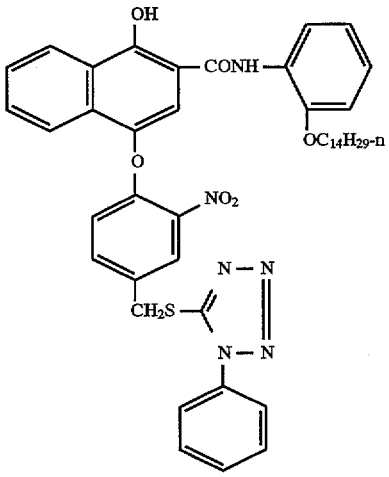
D8
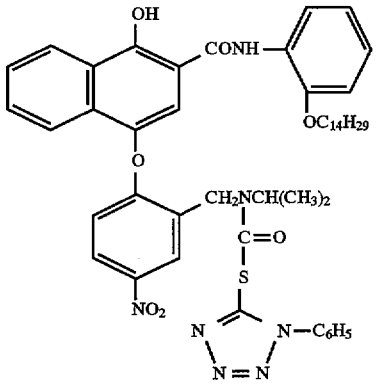
D9
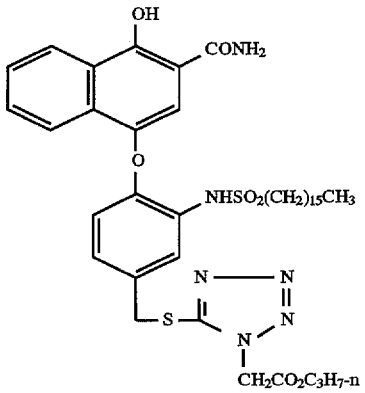

-continued

D10

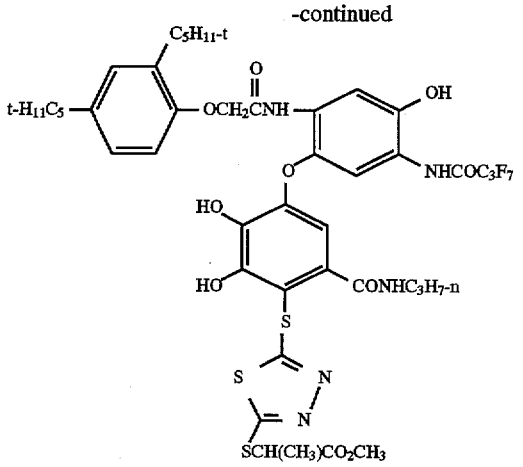

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 83-62,586; 83-09,959; 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90- 093,662; 90-093,663; 90-093,664; 90-093,665; 90-093,666; 90-093,668; 90-094,055; 90-094,056; 90-103,409; 90-151,577.

Especially useful in this invention are tabular grain silver halide emulsions. Specifically contemplated tabular grain emulsions are those in which greater than 50 percent of the total projected area of the emulsion grains are accounted for by tabular grains having a thickness 0f less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHETIC EXAMPLES

The following examples illustrate the preparation of couplers of this invention. The purity of the two-equivalent couplers synthesized was checked by (a) Thin Layer Chromatography in two or three different solvent systems of different polarity, (b) HPLC, (c) 300 MHz FT-NMR and (d) elemental analyses (C, H, N, Cl, S); some samples were also subjected to mass spectral analysis.

EXAMPLE 1

Synthesis of the Coupler I-1 (M20/09)

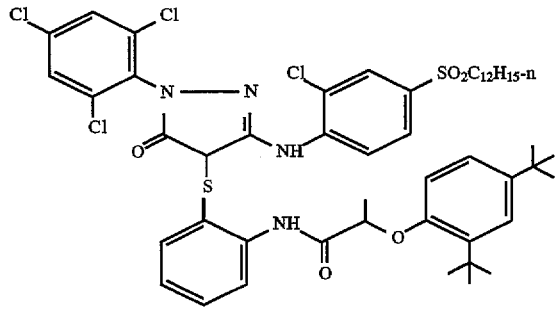

STEP 1: Synthesis of Ethyl 2-(2,4 -di-t-butyl phenoxy) propionate

In a 3-neck 2L-flask a solution of 2,4-di-t-butyl phenol (103 g, 0.500 mol) in 300 mL of DMF was treated portion wise while stirring with NaH (60% in mineral oil), (23 g, 0.575 mol). This solution was stirred until gas evolution ceased, (15 min.) and then treated dropwise with ethyl 2-chloropropionate (70 g, 0.506 mol) given a slight exotherm to 38° C. The reaction mixture was stirred for 16 hr, and was then treated with 20 mL of methanol, and poured onto 300 g of crushed ice. After the ice had melted, the aqueous solution was extracted with EtOAc (500 mL), washed with brine (200 mL), dried ($Na_2SO_4$) and concentrated in vacuo to give a viscous oil (142 g, 90.2% crude yield). HPLC: 95% pure. The crude ester was used without further purification.

$^1$H NMR ($CDCl_3$): δ1.29 (t, 3H), 1.30 (s, 9H), 1.42 (s, 9H), 1.68 (d, 3H), 3.49 (q, 1H), 4.25 (q, 2H), 4.82 (q, 1H), 6.61 (d, 1H), 7.17 (d, 1H), 7.38 (s, 1H).

STEP 2: Synthesis of 2-(2,4-di-t-butyl phenoxy)propionic acid

To a previously prepared solution of methanol (350 mL) and KOH (52 g, 0.930 mol) ethyl 2-(2,4-di-t-butyl phenoxy) propionate (142 g, 0.465 mol) was added dropwise with stirring. The reaction mixture was stirred at reflux for 24 hr, cooled to room temperature, poured onto crushed ice and acidified with concentrated HCl (60 mL). The white solid that precipitated was collected, and washed to a neutral pH with distilled water, and pressed dry to give a white solid (132 g), mp. 106°–111° C., and recrystallized with filtration from 450 mL of MeCN to give a white solid (92.4 g, 71.0% yield), mp. 141°–143° C. $^1$H NMR ($CDCl_3$): δ1.23 (s, 9H), 1.38 (s, 9H), 1.53 (d, 3H), 4.61 (q, 1H), 6.61 (d, 1H), 7.17 (d, 1H), 7.38 (s, 1H), 10.78 (br.s, 1H). Calcd for $C_{17}H_{26}O_3$ (278.4): C, 73.35; H, 9.41. Found C, 72.97; H, 9.25.

STEP 3: Synthesis of 2-(2,4-di-t-butyl phenoxy)propionyl chloride

To a stirred slurry of 2-(2,4-di-t-butyl phenoxy) propionic acid (27.8 g, 0.100 mol) in $CH_2Cl_2$ (280 mL) with 2 mL of DMF, oxalyl chloride (17.0 g, 0.134 mol) was added dropwise. The solution resulted after several minutes was stirred for 2 hr. TLC indicates no starting material. The solution was filtered through a glass wool plug to remove some debris and the filtrate was concentrated in vacuo, residue was washed with $CH_2Cl_2$ (50 mL) and was concentrated once more to give a gelatinous mixture, which was used without further purification.

STEP 4: Synthesis of 2,2'[-(2,4-di-t-butyl phenoxy) propionamido]phenyl disulfide The acid chloride of step 2 (0.100 mol) was suspended in THF (100 mL) and was added in a stream to a 1:1 THF/

Pyridine (160 mL) solution of 2,2'-aminophenyl disulfide (11.0 g, 0.0445 mol) at 0° C. The reaction mixture was poured onto crushed ice (300 g) acidified with concentrated HCl (40 mL). After the ice had melted, the aqueous mixture was decanted and the remaining tacky residue was washed with distilled water (500 mL) and stirred until the residue solidified. The crude white solid was collected and air dried (24.7 g, mp. 211°–218° C.). This crude product was digested for 1 hr. in MeCN, solids collected, and washed sparingly with MeCN to give a white solid (19.9 g, 58.6% yield), mp. 223°–224° C.; TLC (5:1 Ligroin/EtOAc)-homogenous. Calcd for $C_{46}H_{60}N_2O_4S$ (769.13); C, 71.84; H, 7.86; N, 3.64; S, 8.34. Found: C, 71.70; H, 7.61; N, 3.66; S, 7.99. $^1H$ NMR ($CDCl_3$): δ1.25 (s, 9H), 1.48 (s, 9H), 1.70 (d, 3H), 4.74 (q, 1H), 6.71 (d, 1H), 6.74–6.83 (m, 2H), 7.11 (d, 1H), 7.36 (m, 2H), 8.41 (d, 1H), 9.03 (s, 1H). MS: large m/e=768.

STEP 5: Synthesis of Coupler I-1

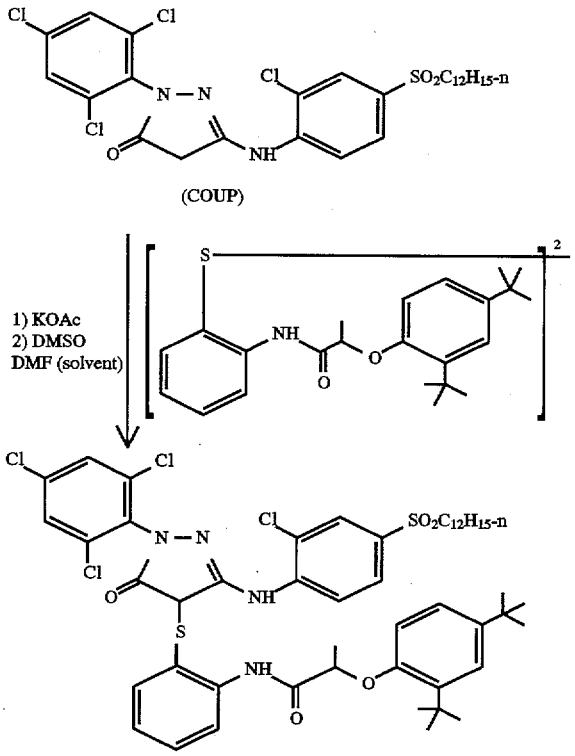

In a 2L Erlenmeyer flask equipped with a magnetic stir bar was mixed in DMF (335 ml) COUP (33.55 g, 0.054 mol) 2,2'[-2,4-di-t-butyl phenoxy)propionamide]phenyl disulfite (21.47 g, 0.028 mol). This solution was treated with KOAc (10.00 g, 0.108 mol) and DMSO (15.5 ml, 0.216 mol). The reaction mixture was allowed to stir at room temperature overnight. TLC analysis (1:1 Ligroin/EtOAc) shows reaction to be complete. The reaction mixture was added slowly with stirring to 500 ml of 10% HCl/crushed ice, and stirred for 30 min. This mixture was then transferred to a separatory funnel and extracted with EtOAc (3×100 ml). The organic layers were combined and washed with cold (5° C.) water (2×500 ml), and brine (1×500 ml), dried over $MgSO_4$, filtered and solvent tripped to give an amber oil (57 g). This crude oil was immediately dissolved in MeCN (500 ml) and chilled (0° C.) to give an off white crystalline solid, collected, washed with cold MeCN, and dried in vacuo to give 36.82 g of coupler I-1, as an off white solid, mp 127°–129° C. Yields 68%.

MS: m/e large 1002 ($Cl_4$). Calcd for $C_{50}H_{62}Cl_4N_4O_5S_2$ (1004.03): C, 59.82; H, 6.12; N, 5.58; Cl, 14.12. Found: C, 58.81; H, 6.19; N, 5.35; Cl, 13.7.

$^1H$ NMR ($CDCl_3$): δ0.86 (t, 3H), 1.22 (br. s, 18H), 1.29 (s, 9H), 1.49 (s, 9H), 1.66 (m, 4H) 1.79 (d, 3H), 3.03 (t, 2H), 4.90 (q, 1H), 6.86 (d, 1H), 7.01 (d, 1H), 7.19–7.23 (m, 2H), 7.40 (s, 1H), 7.46 (s, 2H), 7.61 (s, 1H), 7.71 (d, 1H), 7.85 (s, 1H), 8.27 (s, 1H), 8.57 (d, 1H).

EXAMPLE 2

Synthesis of the Coupler I-2 (M20/03)

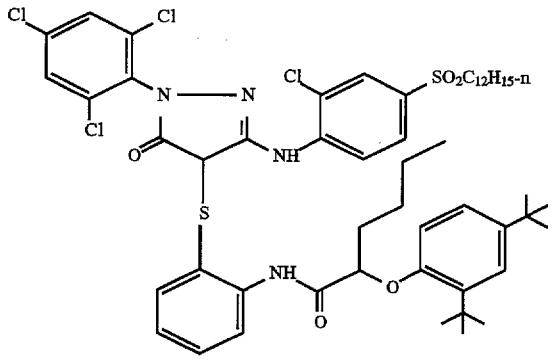

Step 1: Synthesis of Ethyl 2-(2,4-di-g-butyl phenol)butyrate

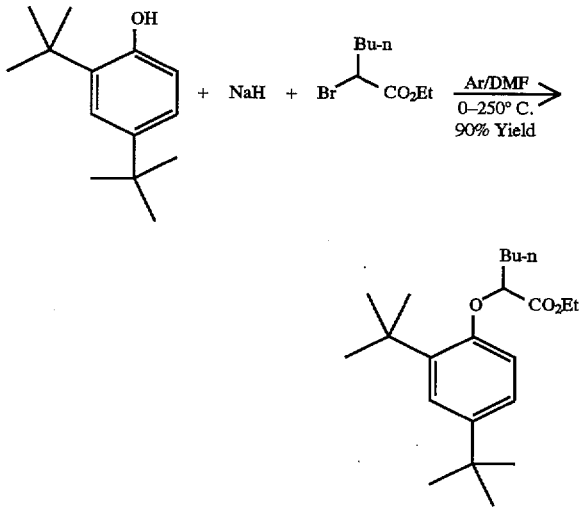

A 500 mL 1 neck flask equipped with a magnetic stirring bar and a pressure equalized addition funnel was charged with sodium hydride, 60% wt. in mineral oil (4.7 g, 117.65 mmol) and dry n-hexanes (50 ml). The hexanes were decanted and the washed sodium hydride was slurried in dry DMF (100 mL) and chilled in a ice/water bath for 20 min while stirring under an Argon atmosphere. A pressure equalized addition funnel was charged with a solution of 2,4-di-t-butyl phenol (23.12 g, 112.05 mmol) in 130 mL of DMF. The phenol solution was then added dropwise over 20 min. Gas evolution ($H_2$) was observed. After addition was completed, the ice bath was removed and the reaction mixture was stirred at room temperature until gas evolution had ceased (1.5 h). A pressure equalized addition funnel was charged with a solution of ethyl bromohexanoate (25.0 g, 112.05 mmol) in 20 mL of DMF, and was added dropwise over 30 min. while stirring at room temperature for 2 h. The reaction was monitored to completion by TLC (20:1 Ligroin/EtOAc). The reaction mixture was stirred overnight. The reaction mixture was added to a mixture of 750 ml of crushed ice and concentrated HCl (25 ml). The resulting mixture was transferred to a separatory funnel and partitioned with EtOAc (300 ml), layers separated, and the aqueous layer extracted with EtOAc (2×250 ml), pooled organics washed with water (2×500 ml), brine (1×500 ml), dried ($MgSO_4$), treated with Darco®, filtered and stripped to give a pale yellow oil (35.13 g, 90% yield), which was used without further purification.

$^1$H NMR ($CDCl_3$): δ0.91 (t, 3H), 1.22 (t, 3H), 1.28 (s, 9H), 1.38 (m, 2H), 1.42 (s, 9H), 1.53 (m, 2H), 2.01 (m, H), 4.19 (q, 2H), 4.73 (t, 1H), 6.58 (d, 1H), 7.11 (d, 1H), 7.38 (s, 1H).

Step 2: Synthesis of Ethyl 2-(2,4-di-t-butyl phenoxy)butyric acid

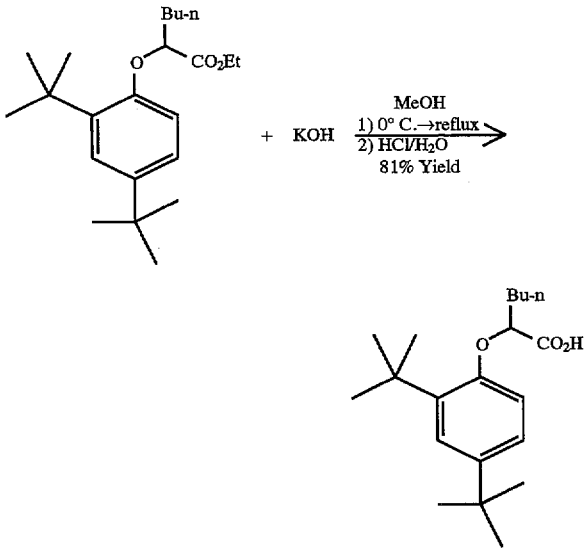

A 500 mL 1-neck flask equipped with a magnetic stirring bar and a pressure equalized addition funnel was charged with potassium hydroxide (12.8 g, 194.59 mmol) and MeOH (150 ml). The solution was chilled in a ice/water bath for 20 min. A pressure equalized addition funnel was charged with a solution of ethyl-2(2,4-di-t-butyl phenoxy)butyrate (33.91 g, 97.29 mmol) in MeOH to give a total volume of 80 mL. The ester solution was then added dropwise over 30 min. After addition was completed the ice bath was removed and the reaction mixture was stirred to room temperature overnight. The reaction was monitored by TLC (1:1 Ligroin/EtOAc +1% HOAc). TLC shows a trace of starting material and a major spot for product. The reaction solution was warmed to reflux for 1 h. TLC still shows starting material. KOH (0.5 g) was added and the reaction medium was heated for 3 h when TLC analysis showed the completion of the hydrolysis. The reaction medium was cooled to room temperature and was added to a mixture of 500 mL of crushed ice and concentrated HCl (25 mL). The resulting mixture was transferred to a separatory funnel and partitioned with EtOAc (250 mL), layers separated, and the aqueous layer extracted with EtOAc (2×150 mL), pooled organics washed brine (1×150 mL), dried ($MgSO_4$), filtered and stripped to give a pale yellow viscous oil (30.98 g). Crude product was chromatographed over silica gel and eluted with 10:1 Ligroin/EtOAc, pure fractions were pooled and stripped to give a pale yellow oil (23.96 g, 77% yield). $^1$H NMR ($CDCl_3$): δ0.91 (t, 3H), 1.29 (s, 9H), 1.38 (m, 2H), 1.43 (s, 9H), 1.56 (m, 2H), 2.01 (m, 2H), 4.72 (t, 1H), 6.60 (d, 1H), 7.11 (d, 1H), 7.35 (s, 1H).

Step 3: Synthesis of 2,2'[-(2,4-di-t-butyl phenoxy) butylamido]phenyl disulfide

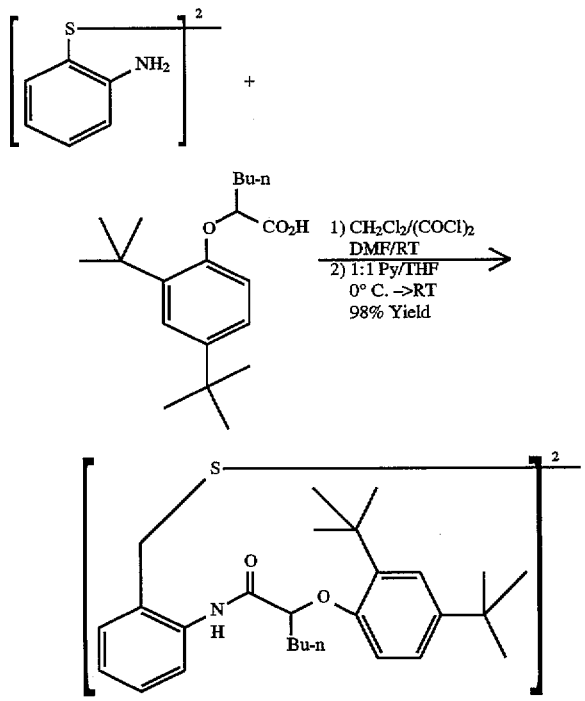

A 250 mL 1-neck flask equipped with a magnetic stirring bar under an Argon atmosphere was charged with ethyl 2-(2,4-di-t-butyl phenoxy)butyric acid (22.94 g, 71.58 mmol) and $CH_2Cl_2$ (75 ml). To this solution oxalyl chloride (9.4 mL, 107.37 mmol, 1.5 Eq.) was added in one portion, followed by several drops of dry DMF. The bubbling reaction solution was stirred at room temperature for 2 h. TLC (4:1 Ligroin/EtOAc) analysis of an aliquot quenched in MeOH shows one major spot corresponding to authentic methyl ester. The reaction was stripped to give an amber oil (Quant. yield), which was used without further purification.

In a 500 mL flask equipped with a magnetic stirring bar, and a pressure equalized additional funnel under an Argon atmosphere was charged with amino disulfide (7.49 g, 30.15 mmol), in 1:1 Pyridine/THF (75 mL) and the resulting solution was chilled in an ice bath for 30 min. The dropping funnel was charged with the above acid chloride (23.5 g, 69.33 mmol, 2.3 Eq.) dissolved in THF (100 mL) and was added dropwise over 20–30 min, and the resulting mixture was allowed to stir overnight warming to room temperature. TLC (4:1 950 Ligroin/EtOAc) analysis shows one major spot. Reaction mixture was poured into 750 mL of crushed ice with 25 mL of conc. HCl to give a tan gummy solid, which was collected, washed with water. The residue was dissolved in EtOAc (500 mL) and transferred to a separatory funnel and washed with water (1×250 mL), brine (1×250 mL), dried ($MgSO_4$), filtered and stripped to give a tan foam (25.19 g, 98% yield), mp 64°–67° C. $^1$H NMR ($CDCl_3$): δ0.89 (t, 3H), 1.22 (s, 9H), 1.37 (m, 2H), 1.43 (s, 9H), 1.56 (s, 9H), 1.62 (m, 2H), 2.10 (m, 2H), 4.66 (t, 1H), 6.73–6.79 (m, 3H), 7.12 (d, 1H), 7.35 (m, 2H), 8.40 (d, 1H), 8.91 (s, 1H). MS: large MH+853; m/e=852. A portion (7.5 g) of the crude product was recrystallized from a minimum volume of hot MeCN, chilled and seeded to give a pale yellow solid which was collected, dried in a vacuum oven at 50° C./72 h to give 5.68 g (76% recovery). The $^1$H NMR was identical to crude product, mp. 128°–132° C. Calcd. for $C_{52}H_{72}N_2O_4S_2$ (853.29): C, 73.20; H, 8.51; N, 3.28; S, 7.52. Found C, 73.15; H, 8.25; N, 3.31; S, 7.48.

Step 4: Synthesis of Coupler I-2

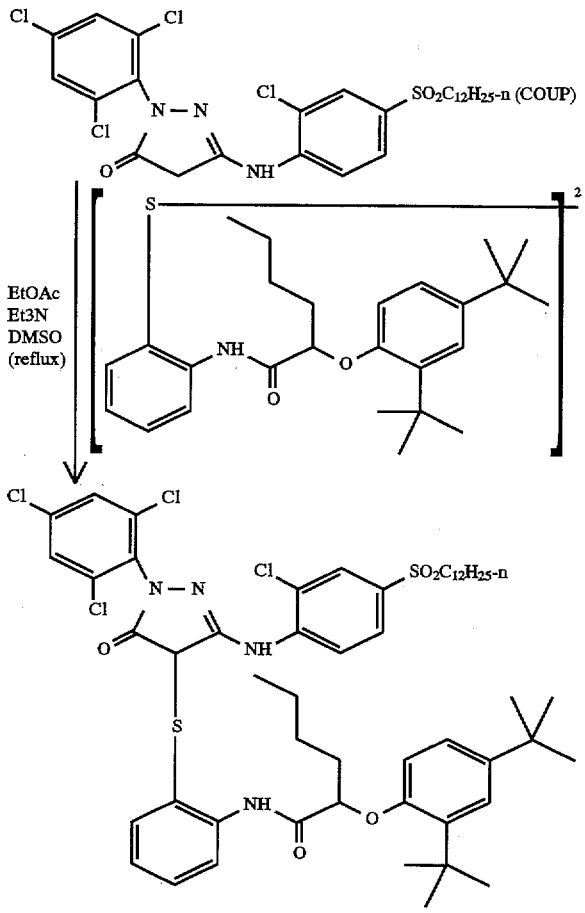

In a 500 mL flask equipped with a condenser and magnetic stirring bar was added 300 mL of EtOAc, COUP (26.88 g, 43.0630.58 mmol), disulfide of step 3 (18.37 g, 21.53 mmol, 0.50 Eq.), Et3N (5.7 ml, 43.06 mmol, 1 Eq), DMSO (30.5 ml, 430.60 mmol, 10 Eq.). The resulting tan solution was warmed to reflux for 4 h. TLC analysis (2:1 Ligroin/EtOAc/1% HOAc) shows a spot of COUP and loss of disulfide. Disulfide (0.5 g, 0.58 mmol) was added and the reaction solution was warmed to reflux overnight. TLC (2:1 Ligroin/EtOAc/1% HOAc) still shows product spot and disulfide. The hot reaction mixture was filtered. After cooling at room temperature, the filtrate was diluted with 100 ml of EtOAc, transferred to separatory funnel. The tan solution was washed with ice cold 1N HCl (3×200 ml), water (2×500 mL), brine (3×300 mL), dried ($MgSO_4$), treated with Darco®, filtered, stripped to give a tan foam. The tan foam was recrystallized from 200 ml of hot abs. Ethanol, chilled to give a white powdery solid, collected, dried at 65° C./72 h in vacuum oven to afford 38.15 g of product. (yield 85% mp 94°–100° C.).

The NMR analysis of the recrystallized product was $^1H$ NMR ($CDCl_3$): δ0.87 (t, 3H), 0.93 (t, 3H), 1.26 (br s, 18H), 1.31 (s, 9H), 1.40 (m, 2H), 1.51 (s, 9H) 1.63 (m, 4H), 2.15 (m, 2H), 3.03 (t, 2H), 4.81 (t, 1H), 6.82 (d, 1H), 6.84 (d, 1H), 7.15–7.22 (m, 5H), 7.31 (d, 1H), 7.41 (s, 1H), 7.45 (s, 2H), 7.65 (s, 1H), 7.71 (d, 1H), 7.86 (s, 1H), 8.16 (s, 1H), 8.60 (d, 1H). Calcd. for $C_{53}H_{68}Cl_4N_4O_5S_2$ (1047.10): C, 60.80; H, 6.55; N, 5.35; Cl, 13.54; S, 6.12. Found C, 60.21; H, 6.49; N, 5.22; Cl, 13.23; S, 5.90. MS: large m/e=1044 ($Cl_4$).

EXAMPLE 3

Synthesis of I-3 (M20/04)

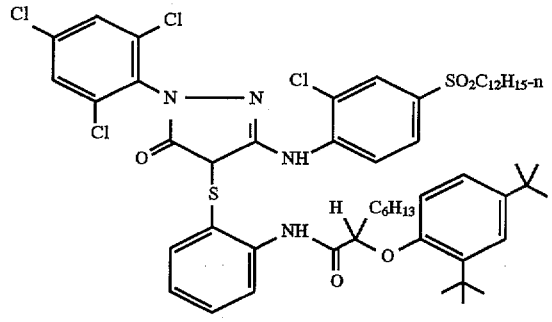

Coupler C-6 was prepared according to the above-described general method. The crude product was firstly purified by chromatography. The foam thus obtained is then recrystallized from MeCN. Even though the obtention of a crystallized coupler requires a previous chromatography step, Coupler I-3 was obtained in an easily handleable crystallized solid form (mp.110°–120° C.).

It is clear from examples 1–3 that the couplers according to the present invention are easily crystallizable, and consequently easily manufacturable in a large scale.

EXAMPLE 4

Comparative Couplers

The following structures are included for comparative purposes. The type and the required purification method are summurized in Table 1.

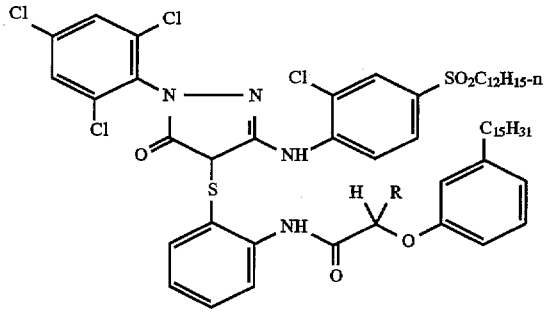

TABLE 1

| Examples | R | Type | Purification Method |
|---|---|---|---|
| C-4(comp.) | H | Cryst. | Recrystal. from butyronitrile mp. 100° C. |
| C-7(comp.) | Methyl | Amorphous | (glass) |
| C-8(comp.) | n-Butyl | Amorphous | Chromatography (oil) |
| C-9(comp.) | n-Hexyl | Amorphous | Chromatography(glass) |

EXAMPLE 5

Photographic Examples

On a gel-subbed, polyethylene-coated paper support were coated the following layers:

First layer

An underlayer containing 3.23 grams gelatin per square meter.

Second layer

A photosensitive layer containing per square meter, 1.61 grams gelatin, 0.17 gram green-sensitized silver chloride emulsion (expressed as silver), a dispersion containing $3.29\times10^{7}$ mote of coupler, and 0.043 gram surfactant Alkanol XC™ manufactured by Dupont Co. (in addition to the Alkanol XC™ used to prepare the coupler dispersion). The coupler dispersion contained the coupler, all of the gelatin in the layer except that supplied by the emulsion, an amount of tritolyl phosphate (mixed isomers) equal to the weight of coupler, an amount of N,N-dibutyl-2-butoxy-5-t-octylaniline equal to the weight of coupler multiplied by 1.17, and an amount of Ciba-Geigy antioxidant CG21-40 equal to the weight of coupler multiplied by 0.17, and an amount of Alkanol XC™ equal to the weight of gelatin in the dispersion multiplied by 0.1.

Third layer

An ultraviolet-absorbing layer containing (per square meter) 1.33 grams gelatin, 0.73 grams 2-(2H-benzotriazol-2-yl)-4,6-bis(1,1-dimethylpropyl)-phenol, 0.13 gram Tinuvin 326™ manufactured by Ciba-Geigy, and 0.043 gram Alkanol XC™.

Fourth layer

A protective layer containing per square meter, 1.40 grams gelatin, 0.14 gram bis(vinylsulfonyl)methyl ether, 0.043 gram Alkanol XC™, and $4.40\times10^{-6}$ gram tetraethylammonium perfluorooctanesulfonate.

Processed samples were prepared by exposing the coatings through a step wedge and processing as follows:

| Process step | Time (min.) | Temp. (°C.) |
|---|---|---|
| Developer | 0.75 | 35.0 |
| Bleach-Fix | 0.75 | 35.0 |
| Water wash | 1.50 | 35.0 |

The solutions used in the above process had the following compositions (amounts per liter of solution):

| Developer | |
|---|---|
| Triethanolamine | 12.41 g |
| Blankophor REU™ manuf. by Mobay Corp. | 2.30 g |
| Lithium polystyrene sulfonate | 0.09 g |
| N,N-Diethylhydroxylamine | 4.59 g |
| Lithium sulfate | 2.70 g |
| N-{2-[(4-amino-3-methylphenyl)ethylaminol]-ethyl}methanesulfonamide, sesquisulfate | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

The treated samples were then subjected to tests to evaluate the photographic properties of the elements as follows:

Light Stability

Strips were faded under three conditions: (1) Simulated daylight: 50 klux (2 and 4 weeks); (2) Simulated sunshine: 50 klux (2 and 4 weeks), and (3) Simulated low intensity daylight: 5.4 klux (12 and 24 weeks). The following data include dye fades from initial densities of 1.0 and 1.7, and printout (P.O.) (light-induced discoloration of the unexposed portions after processing measured by blue density increase from Dmin).

The results of testing are shown in Tables 2 where the 3 where the inventive and comparison samples are grouped for ready comprehension.

These results were unexpected and show the advantages of the present invention. A comparison of the results for the invention couplers versus the control comparative amorphous sample C-3 shows that the present crystallized couplers provide a light stability comparable to coupler C-3. The comparison of the inventive couplers with comparative crystallized coupler C-4 shows an unexpected improvement of the printout. Further, the results obtained from comparative amorphous coupler C-8 which differs from the coupler I-1 only by the substituents $R^4$ show that the inventive coupler has an improved crystallinity and printout without degrading the other stability results.

TABLE 2

High Intensity Light Stability

| | 50 klux Daylight Change in Density | | | | 50 klux Sunshine Change in Density | | | |
|---|---|---|---|---|---|---|---|---|
| | 2 weeks | | 4 weeks | | 2 weeks | | 4 weeks | |
| Coupler | 1.0 | P.O. | 1.0 | P.O. | 1.0 | P.O. | 1.0 | P.O |
| C-3 (control) Amorphous | −.22 | .02 | −.58 | .10 | −.21 | .04 | −.55 | .12 |
| C-4 (comp.) cryst. | −.20 | .06 | −.50 | .14 | −.18 | .09 | −.46 | .16 |
| C-7 (comp.) Amorphous | −.21 | .04 | −.50 | .12 | −.18 | .06 | −.45 | .15 |
| I-1 (Inv.) | −.22 | .02 | −.55 | .10 | −.20 | .04 | −.53 | .11 |
| I-2 (Inv.) | −.24 | .02 | −.61 | .09 | −.23 | .04 | −.59 | .12 |
| I-3 (Inv.) | −.22 | .02 | −.59 | .10 | −.24 | .04 | −.58 | .12 |

TABLE 3

Low Intensity Light Stability

| | 5.4 klux Daylight Change in Density | | | | | |
|---|---|---|---|---|---|---|
| | 12 weeks | | | 24 weeks | | |
| Coupler | 1.0 | 1.7 | Printout | 1.0 | 1.7 | Printout |
| C-3 (control) Amorphous | −.22 | −.29 | .01 | −.52 | −.70 | .14 |
| C-4 (comp.) cryst. | −.20 | −.27 | .08 | −.42 | −.52 | .19 |
| C-7 (comp.) Amorphous | −.21 | −.25 | .03 | −.41 | −.52 | .16 |
| I-1 (Inv.) | −.22 | −.30 | .01 | −.50 | −.70 | .14 |
| I-2 (Inv.) | −.24 | −.32 | .01 | −.58 | −.83 | .13 |
| I-3 (Inv.) | −.25 | −.30 | 0 | −.56 | −.76 | .14 |

Other multilayer photographic elements can be constructed using the 5-pyrazolone couplers, as required by the present claims. In particular, specifically contemplated is the construction of multilayer elements of the structure described in *Research Disclosure* February 1995, Item 37038, published by Kenneth Mason Publications, Ltd., Dudley House, 12 North Street, Emsworth, Hampshire PO107DQ, ENGLAND, Section XVII, page 96–98 (this publication will be referenced below simply as "Item 37038"), including such elements using the alternative magenta layer I, and alternative yellow layers I and II. In such elements a compound of formula (I) as claimed (including specifically, any of those compounds I-1 to I-3 above), would be used as the coupler in the magenta layer instead of the coupler described in the publication. Particularly, a suitable multilayer element is that on pages 97–98 of Item 37038, but with the M-1 coupler in layer 3 (green sensitive layer) being replaced by 0.250 g/m$^2$ of coupler I-1 above. The resulting element with I-1 is referenced here as "Multilayer A" Other suitable elements can be constructed as described on pages 97–98 of Item 37038 but using in turn, couplers I-2 and I-3 identified below to produce elements referenced herein as "Multilayer B", and "Multilayer C", respectively. Structures of the compounds identified in the layers below are those appearing in Item 37038, except for image couplers I-1 to I-3 of the present invention, the structure for which are given above:

ALTERNATE MAGENTA LAYER
Layer 3; Green sensitive layer

| | |
|---|---|
| Gelatin | 1.270 g/m$^2$ |
| Green sensitive silver (green EM-1) | 0.160 g Ag/m$^2$ |
| I-1 | 0.250 g/m$^2$ |
| Dibutyl phthalate | 0.250 g/m$^2$ |
| ST-5 | 0.360 g/m$^2$ |
| Dioctyl hydroquinone | 0.060 g/m$^2$ |

Further elements can be constructed using the same structures as described above for each of the three elements of Multilayer A to Multilayer C, except in each, first replacing the Layer 1 ("Blue sensitive Layer") as described on page 97 of Item 37038, with "Alternate Yellow Layer I" described on page 99 of that reference. Additional elements can be constructed using the same procedure but using "Alternate Yellow Layer II" on page 99 of Item 37038.

The preceding examples are set forth to illustrate specific embodiments of this invention and are not intended to limit the scope of the elements of the invention. It will be understood that variations and modifications can be effected within the spirit and scope of the invention.

The entire contents of the various copending applications as well as patents and other publications cited in this specification are incorporated herein by reference.

What is claimed is:

1. A photographic element comprising a support bearing at least one silver halide emulsion layer having associated therewith a 5-pyrazolone photographic coupler represented by the formula (I):

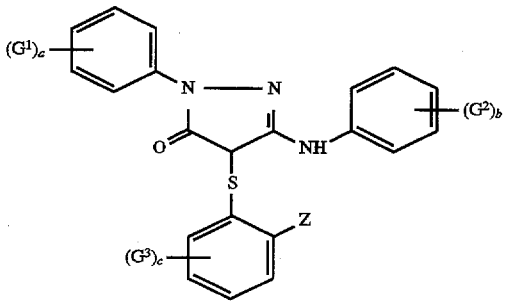

wherein a) substituents $G^1$, $G^2$ and $G^3$ are individually selected from the group consisting of hydrogen, halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, alkylsulfoxyl, arylsulfoxyl, arylsulfonyl, alkoxycarbonylamino, aryloxycarbonylamino, alkylureido, arylureido, acyloxy, nitro, cyano, and carboxy groups;

b) a and b are individually integers from 0 to 5, provided that the sum of the sigma values for $G^1$ and $G^2$ is at least 1.3; c is an integer from 0 to 4;

c) Z is a group of the formula (II):

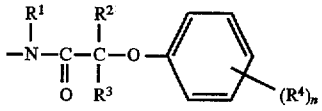

wherein $R^1$ is selected from the group consisting of hydrogen, alkyl, alkenyl, aryl, acyl, and heterocyclic groups; $R^2$ is hydrogen; $R^3$ is selected from the group consisting of hydrogen and alkyl groups having from 1 to 16 carbon atoms; and each $R^4$ is an independently selected methyl or silyl group containing three substituents identical to each other.

2. The element according to claim 1 wherein n is 1.

3. The element according to claim 1 wherein n is 2 and; $R^4$ groups are located on the 2-, 4-positions, 2-,6-positions or 3-, 5-positions of the aryl group.

4. The element according to claim 1 wherein n is 3 and; $R^4$ groups are at 2-, 4-, 6-positions of the aryl group.

5. The element according to claim 1 wherein $R^4$ has the formula:

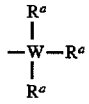

wherein W is selected from the group consisting of a carbon atom and a silicon atom, $R^a$ is selected from the group consisting of hydrogen, alkyl group from 1 to 3 carbon atoms, and heterocyclic or carbocyclic aromatic group.

6. The element of claim 1 wherein the 5-pyrazolone photographic coupler has the following formula:

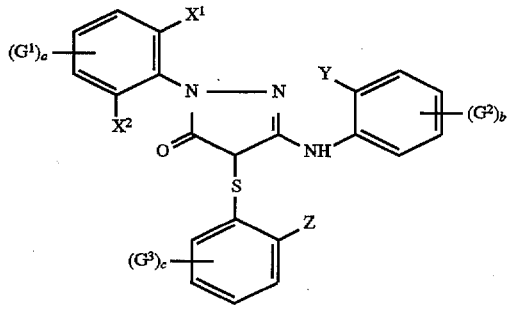

wherein a) substituents $X^1$ and $X^2$ are selected from the group consisting of $G^1$; Y is selected from the group consisting of $G^2$; and $G^1$, $G^2$ and $G^3$ being such as defined in claim 1, b) a is from 0 to 3; and b is from 0 to 4 provided the sum of the sigma values for $G^1$, $X^1$, $X^2$, Y and $G^2$ is at least 1.3; and c is from 0 to 4;

c) Z is defined by the formula:

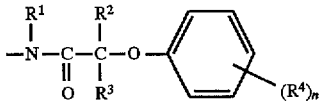

wherein $R^1$ is selected from the group consisting of hydrogen, alkyl, alkenyl, aryl, acyl, and heterocyclic groups; $R^2$ is hydrogen; $R^3$ is selected from the group consisting of hydrogen, substituted or unsubstituted alkyl having from 1 to 16 carbon atoms; $R^4$ has the following formula:

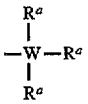

wherein W is selected from the group consisting of carbon atom and silicon atom, $R^a$ is selected from the group consisting of hydrogen, alkyl group from 1 to 3 carbon atoms, and heterocyclic or carbocyclic aromatic group; and n is 1, 2 or 3.

7. The element of claim 1 wherein the 5-pyrazolone photographic coupler has the following formula:

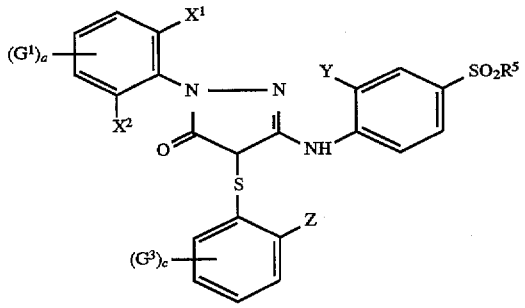

wherein a) substituents $G^1$, $G^3$, $X^1$, $X^2$ and Y are such as defined in claim 6; and $R^5$ is selected from the group consisting of alkyl group having from 1 to 20 atom carbons, —NHR' wherein R' is an alkyl group having from 1 to 20 carbon atoms;

b) a is from 0 to 3 provided that the sum of the sigma values for $G^1$, $X^1$, $X^2$, Y, $—SO_2R^5$ is at least 1.3; and c is from 0 to 4;

c) Z is a group of the formula:

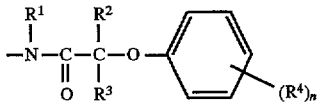

wherein $R^1$ is selected from the group consisting of hydrogen, alkyl, alkenyl, aryl, acyl, and heterocyclic groups; $R^2$ is hydrogen; $R^3$ is selected from the group consisting of hydrogen, alkyl group having from 1 to 16 carbon atoms; $R^4$ has the following formula:

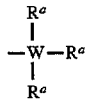

wherein W is selected from the group consisting of carbon atom and silicon atom, $R^a$ is selected from the group consisting of hydrogen, alkyl group having from 1 to 3 atom carbons, and heterocyclic or carbocyclic aromatic group; and n is 1, 2 or 3.

8. The element according to claim 7 wherein $R^4$ group has the formula:

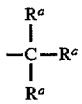

wherein $R^a$ are as defined in claim 7.

9. The element according to claim 8 wherein $R^a$ is $—CH_3$.

10. The element of claim 1 wherein a is not be an integer which, combined with the selection of $X^1$ and $X^2$, allows the number of chloride substituents on the ring containing $G^1$ to exceed 3.

* * * * *